US008281575B2

(12) United States Patent
Merchant et al.

(10) Patent No.: US 8,281,575 B2
(45) Date of Patent: Oct. 9, 2012

(54) EMISSIONS CONTROL FILTER ASSEMBLY AND SYSTEM

(75) Inventors: Jack Albert Merchant, Peoria, IL (US); Paul Frederick Olsen, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 683 days.

(21) Appl. No.: 12/222,006

(22) Filed: Jul. 31, 2008

(65) Prior Publication Data

US 2010/0024407 A1 Feb. 4, 2010

(51) Int. Cl.
*F01N 3/00* (2006.01)

(52) U.S. Cl. ..... 60/297; 60/274; 60/302; 60/311

(58) Field of Classification Search ..... 60/274, 60/284–287, 295–301; 50/490, 495, 282.3, 50/428.1, 523; 96/108–154
See application file for complete search history.

(56) References Cited

U.S. PATENT DOCUMENTS

| | | | | | |
|---|---|---|---|---|---|
| 3,350,860 | A | * | 11/1967 | Grassel et al. | 96/129 |
| 4,032,310 | A | * | 6/1977 | Ignoffo | 422/170 |
| 4,211,543 | A | | 7/1980 | Tokar et al. | |
| 4,411,254 | A | | 10/1983 | Field et al. | |
| 4,415,344 | A | | 11/1983 | Frost et al. | |
| 4,448,754 | A | * | 5/1984 | Isogai et al. | 422/179 |
| 4,866,932 | A | * | 9/1989 | Morita et al. | 60/288 |
| 4,887,426 | A | * | 12/1989 | Goerlich | 60/274 |
| 5,211,846 | A | * | 5/1993 | Kott et al. | 210/232 |
| 5,246,472 | A | | 9/1993 | Herman et al. | |
| 5,285,640 | A | * | 2/1994 | Olivo | 60/274 |
| 5,603,742 | A | * | 2/1997 | Nagashima et al. | 55/502 |
| 5,655,366 | A | | 8/1997 | Kawamura | |
| 5,755,842 | A | | 5/1998 | Patel et al. | |
| 6,235,195 | B1 | * | 5/2001 | Tokar | 210/238 |
| 6,241,794 | B1 | | 6/2001 | Jadran et al. | |
| 6,364,923 | B1 | | 4/2002 | Wiedmeyer et al. | |
| 6,565,636 | B1 | | 5/2003 | Thompson | |
| 6,623,540 | B2 | | 9/2003 | Clayton et al. | |
| 6,749,654 | B2 | | 6/2004 | Hilliard | |
| 6,837,336 | B2 | | 1/2005 | Gault et al. | |
| 6,994,743 | B2 | | 2/2006 | Brownell et al. | |
| 7,234,296 | B2 | | 6/2007 | Kojima | |
| 7,552,586 | B1 | * | 6/2009 | White | 60/302 |
| 7,788,913 | B2 | * | 9/2010 | Midgley et al. | 60/302 |
| 2004/0031264 | A1 | * | 2/2004 | Kojima | 60/311 |
| 2005/0115224 | A1 | * | 6/2005 | Kojima | 60/282 |
| 2006/0102549 | A1 | | 5/2006 | Wright | |
| 2006/0191247 | A1 | * | 8/2006 | Thaler | 55/523 |
| 2007/0101705 | A1 | * | 5/2007 | Knitt | 60/295 |
| 2007/0137188 | A1 | * | 6/2007 | Ohya et al. | 60/311 |
| 2007/0151231 | A1 | * | 7/2007 | Rinaldi | 60/286 |
| 2007/0199289 | A1 | | 8/2007 | Bland, Jr. et al. | |
| 2007/0214777 | A1 | | 9/2007 | Allansson et al. | |
| 2007/0261823 | A1 | | 11/2007 | Masters et al. | |

* cited by examiner

*Primary Examiner* — Thomas Denion
*Assistant Examiner* — Jesse Bogue
(74) *Attorney, Agent, or Firm* — Finnegan, Henderson, Farabow, Garrett & Dunner LLP

(57) ABSTRACT

A removable exhaust treatment unit for an aftertreatment assembly is provided. The removable exhaust treatment unit include a housing, at least one exhaust treatment element coupled within the housing, and a flange on one end of the housing. The removable exhaust treatment unit also includes a plurality of apertures on the flange configured to receive a plurality of fasteners. The removable exhaust treatment unit further includes at least one handle coupled to the flange.

28 Claims, 3 Drawing Sheets

EMISSIONS CONTROL FILTER ASSEMBLY AND SYSTEM

TECHNICAL FIELD

The present disclosure relates generally to emissions control and, more particularly, to an emissions control filter assembly and system.

BACKGROUND

Combustion engines such as gasoline engines, natural gas engines, and diesel engines are widely employed on machines such as wheel loaders, excavators, on- or off-highway vehicles, etc. While generating power to drive a machine, combustion engines may also produce exhaust gases containing toxic gases, particulate matter, etc. As environmental concerns increase globally, great attention has been paid to machine emissions control. Various aftertreatment assemblies have been employed in the exhaust systems of machines to clean exhaust gases. For example, emissions control filter assemblies such as diesel particulate filters have been used to remove particulate matter from the exhaust gases. However, the substrates inside the emissions control filter assemblies may become saturated over time, for example, because of accumulation of particulate matter on the filter substrates. Therefore, filter substrates may need servicing, such as cleaning or replacement.

Servicing a filter substrate can be a labor intensive, costly, and time consuming process. The filter substrate is typically located inside the emissions control filter assembly, which is usually securely installed on the machine as part of an exhaust system. To access the filter substrate, typically one must disassemble the emissions control filter assembly from the machine. This may require the use of welding tools or other tools to cut the connection between the filter assembly and the exhaust pipes. After removing the filter assembly from the machine, the assembly may need to be further disassembled to allow access to the filter substrate. After the filter substrate is replaced or cleaned, the filter assembly is then re-assembled, and re-installed in the exhaust system on the machine. The entire process may require a significant amount of machine down time, and could be costly.

An exhaust gas cleanup apparatus is described in U.S. Pat. No. 7,234,296 (the '296 patent) issued to Kojima on Jun. 26, 2007. The apparatus of the '296 patent includes a cylindrical outer casing, and an inner casing detachably located in the outer casing. The inner casing is removable from the outer casing and includes two handles located on its outer circumferential surface. A pressing member is provided at the downstream end of the outer casing to press against the inner casing and cover the end of the outer casing, and an exhaust gas emitting hole is provided on the pressing member. The illustrated embodiments of the '296 patent relate to an exhaust gas purifier that is intended to be located at the terminal end of the exhaust system. The '296 patent also discloses generally, but does not illustrate, that the exhaust gas purifier may be located at the middle of the exhaust gas passage by connecting a detachable, flexible pipe.

The apparatus disclosed in the '296 patent may not be applicable to some exhaust systems where an aftertreatment assembly is disposed in a middle section of the exhaust system upstream of other exhaust system components. Installation of the apparatus disclosed in the '296 patent in a middle section of an exhaust system would result in the exhaust gas emitting hole on the pressing member being connected with, for example, an exhaust pipe, or another component of the exhaust system. Such a connection would be problematic for readily accessing the inner casing and removing the aftertreatment assembly. Even with the use of a detachable and flexible pipe, it may be difficult to access and open the pressing member and service the aftertreatment assembly.

The method and system of the present disclosure are directed toward improvements in the existing technology.

SUMMARY

In one aspect, the present disclosure is directed to a removable exhaust treatment unit for an aftertreatment assembly. The removable exhaust treatment unit include a housing, at least one exhaust treatment element coupled within the housing, and a flange on one end of the housing. The removable exhaust treatment unit also includes a plurality of apertures on the flange configured to receive a plurality of fasteners. The removable exhaust treatment unit further includes at least one handle coupled to the flange.

In another aspect, the present disclosure is directed to an engine system. The engine system includes an internal combustion engine configured to combust air and fuel to produce exhaust gases. The engine system also includes a first exhaust conduit, a second exhaust conduit, and an emissions control filter assembly. The emissions control filter assembly includes an enclosure defining an interior and including an inlet, an outlet, and an opening. The inlet is connected with the first exhaust conduit and configured to receive a flow of exhaust gases from the first exhaust conduit. The outlet is connected with the second exhaust conduit and configured to direct the flow of exhaust gases to the second exhaust conduit. The opening is configured to provide access to the interior. The emissions control filter assembly also includes a cover portion spaced from the outlet and removably coupled with the enclosure. The cover portion is configured to cover the opening and to prevent the flow of exhaust gases from flowing through the opening. The emissions control filter assembly further includes a removable exhaust treatment unit disposed within the interior of the enclosure and removably coupled with the enclosure. The removable exhaust treatment unit is configured to contain at least one exhaust treatment element and to be removable through the opening when the cover portion is removed.

DETAILED DESCRIPTION

Figure 1:
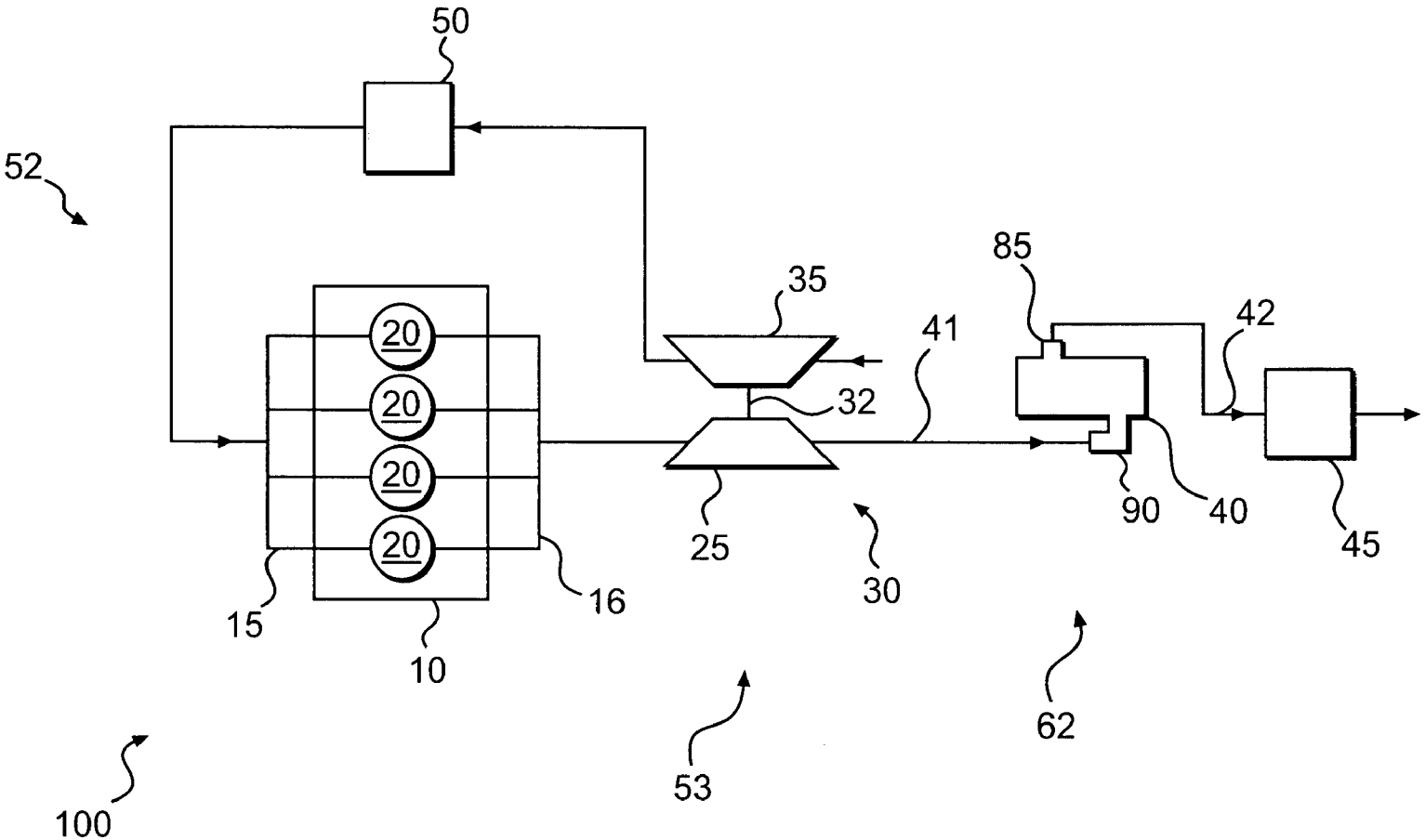
FIG. 1 is a schematic illustration of an exemplary engine system in which the disclosed emissions control filter assembly may be employed.

FIG. 1 schematically illustrates an exemplary engine system 100. The engine system 100 may be employed in any machine, for example, a wheel loader, a track-type tractor, an excavator, an on- or off-highway vehicle, a power generator, etc. The engine system 100 may include an internal combustion engine 10, which may be a gasoline engine, a diesel engine, a natural gas engine, or any other engine that combusts a mixture of air and fuel to produce power, and produces exhaust gases as a byproduct of the combustion.

The internal combustion engine 10 may include a plurality of cylinders 20. The plurality of cylinders 20 may include a plurality of intake valves (not shown) and a plurality of exhaust valves (not shown). The engine system 100 may include an air intake system 52 and an exhaust system 53. The air intake system 52 may include an air intake manifold 15 configured to deliver engine intake air to the plurality of cylinders 20. The air intake system 52 may include other components known in the art, for example, an air filter (not shown) and other components to be discussed below.

The exhaust system 53 may include an exhaust manifold 16 associated with the plurality of cylinders 20 of the internal combustion engine 10. In some embodiments, the exhaust system 53 may include a turbine 25 of a turbocharger 30. The turbine 25 may be disposed downstream of the exhaust manifold 16 to receive exhaust gases from the cylinders 20. The exhaust gases may drive the turbine 25 to rotate, which may cause an associated compressor 35 to rotate through a common rotating shaft 32 connecting the turbine 25 and the compressor 35. The compressor 35 may be a component of air intake system 52, and may draw air from the atmosphere, compress the air, and deliver the compressed air to the air intake manifold 15. Before entering the air intake manifold 15, the compressed air may be cooled by a cooling unit 50 disposed downstream of the compressor 35 and upstream of the air intake manifold 15 in an air flow in the air intake system 52.

The exhaust system 53 may also include an aftertreatment assembly 62, for example, an emissions control filter assembly 40. The exhaust system 53 also may include one or more additional aftertreatment assemblies, such as exhaust gas treatment device 45. It will be understood that it is contemplated that aftertreatment assembly 62 and any additional aftertreatment assemblies could include any of an exhaust filtering component such as a diesel particulate filter, a catalytic treatment component, a NOx treatment component, a SOx treatment component, or any other exhaust gas treatment component. The emissions control filter assembly 40 may be located downstream of the turbocharger 30 and upstream of the exhaust gas treatment device 45. In some embodiments, the emissions control filter assembly 40 may also be located upstream of the turbocharger 30, or downstream of the exhaust gas treatment device 45. The emissions control filter assembly 40 may include an inlet 90 connected to a first exhaust conduit 41 to receive a flow of exhaust gases from the first exhaust conduit 41, and an outlet 85 connected to a second exhaust conduit 42 and configured to direct the flow of exhaust gases to the second exhaust conduit.

In some embodiments, the engine system 100 may not include a turbocharger, may include one or more superchargers driven by the internal combustion engine 10 or by an auxiliary motor, or may include both turbocharger(s) and supercharger(s). It is contemplated that the engine system 100 may also include a turbo compounding device (not shown). The engine system 100 may include other components known in the art.

Figure 2:
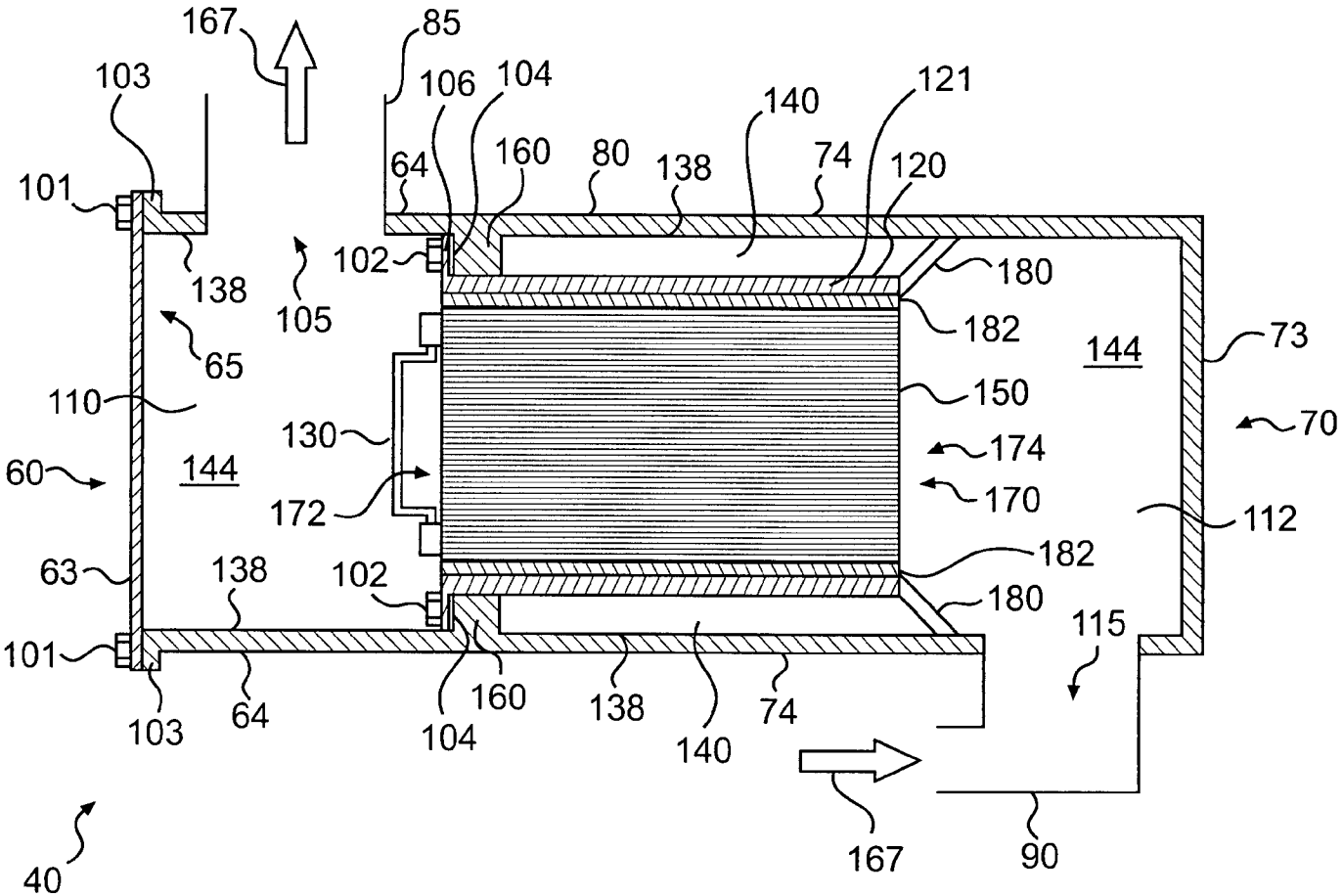
FIG. 2 is a schematic cross-sectional view of an exemplary emissions control filter assembly consistent with disclosed embodiments.

Relating to FIG. 2, the emissions control filter assembly 40 may include an enclosure 80 having a cylindrical shape or any other suitable shape. The enclosure 80 may define an interior 144 formed by an interior surface 138. The enclosure 80 may include the inlet 90, the outlet 85, and an opening 65 configured to provide access to the interior 144. The enclosure 80 may also include a first and a second circumferential side surface portions 64 and 74. Outlet 85 may be located on the first circumferential side surface portion 64 adjacent a first end 60 of the enclosure 80, and inlet 90 may be located on the second circumferential side surface portion 74 adjacent a second end 70 of the enclosure 80. The outlet 85 and the inlet 90 may be integrated parts of the enclosure 80. Exhaust gases may be directed into the enclosure 80 from the inlet 90, and discharged from the enclosure 80 through the outlet 85, as indicated by flow direction 167. The interior 144 may be divided into a first chamber 110 and a second chamber 112 by an annular support portion 160 inwardly protruding from the interior surface 138.

The opening 65 may be provided at the first end 60 of the enclosure 80. The enclosure may include a removable cover portion 63 spaced from the outlet 85, and configured to cover the opening 65 and prevent the exhaust gases from flowing through the opening 65. When the removable cover portion 63 is removed, the opening 65 may provide access to the interior 144 of the enclosure 80. The removable cover portion 63 may be coupled with flange 103 of the enclosure 80 through various means known in the art, for example, through screws or bolts 101. Alternatively, although not shown in FIG. 2, the opening 65 may also be an opening on the first circumferential side surface portion 64, and the removable cover portion 63 may be located on the side of the enclosure 80 to cover the opening 65. As shown in FIG. 2, the first chamber 110 may be in flow communication with the outlet 85 through an opening 105. The second chamber 112 may be in flow communication with the inlet 90 through an opening 115. The enclosure 80 may include an integral cover portion 73 covering the second end 70.

FIG. 2 also shows a removable exhaust treatment unit 120 disposed within the interior 144 of the enclosure 80 and removably coupled with the enclosure 80 via a flange 106. The flange 106 may be removably coupled with the annular support portion 160. The flange 106 may include a plurality of apertures 108 (shown in FIG. 3) configured to receive a plurality of fasteners 102, through which the flange 106 may be coupled with the annular support portion 160. A suitable seal 104 may be provided between the flange 106 and the annular support portion 160. The removable exhaust treatment unit 120 may include a housing 121 defining a chamber 170, which may include an inlet end 174 and an outlet end 172. The housing 121 may include a cylindrical shape, or any other suitable shape. Exhaust gases may flow into the removable exhaust treatment unit 120 through the inlet end 174, and flow out of the removable exhaust treatment unit 120 to the first chamber 110 of the enclosure 80 through the outlet end 172. The removable exhaust treatment unit 120 may be at least partially located within the second chamber 112.

In some embodiments, as illustrated in FIG. 2, a space 140 may be formed between the removable exhaust treatment unit 120 and the interior surface 138 of the enclosure 80 in the second chamber 112. A flow director 180 may be located adjacent the inlet end 174 of the removable exhaust treatment unit 120. The flow director 180 may include an annular shape, or any other suitable shape, which may depend on the shape of the removable exhaust treatment unit 120. The flow director 180 may connect the inlet end 174 of the removable exhaust treatment unit 120 and the interior surface 138 of the enclosure 80. The flow director 180 may be configured to seal the space 140, and to direct exhaust gas from the second chamber 112 of the enclosure 80 into the inlet end 174 of the removable exhaust treatment unit 120, and may inhibit exhaust gases from being directed into the space 140.

The removable exhaust treatment unit 120 may include at least one exhaust treatment element 150 coupled with the housing 121 and located within the chamber 170. In some embodiments, exhaust treatment element 150 may be removably coupled to the removable exhaust treatment unit 120, for example, by fasteners, clamps, press fitting, etc. For example, as shown in FIG. 2, the exhaust treatment element 150 may be press fit into the chamber 170 through a mating material 182, such as a fiber glass. The exhaust treatment element 150 may be any suitable type of exhaust treatment element known in the art, such as a diesel particulate filter, a SOx treatment component, a NOx treatment component, a catalyst, etc. In some embodiments, the at least one exhaust treatment element is a filter substrate, such as a diesel particulate filter substrate.

Figure 3:
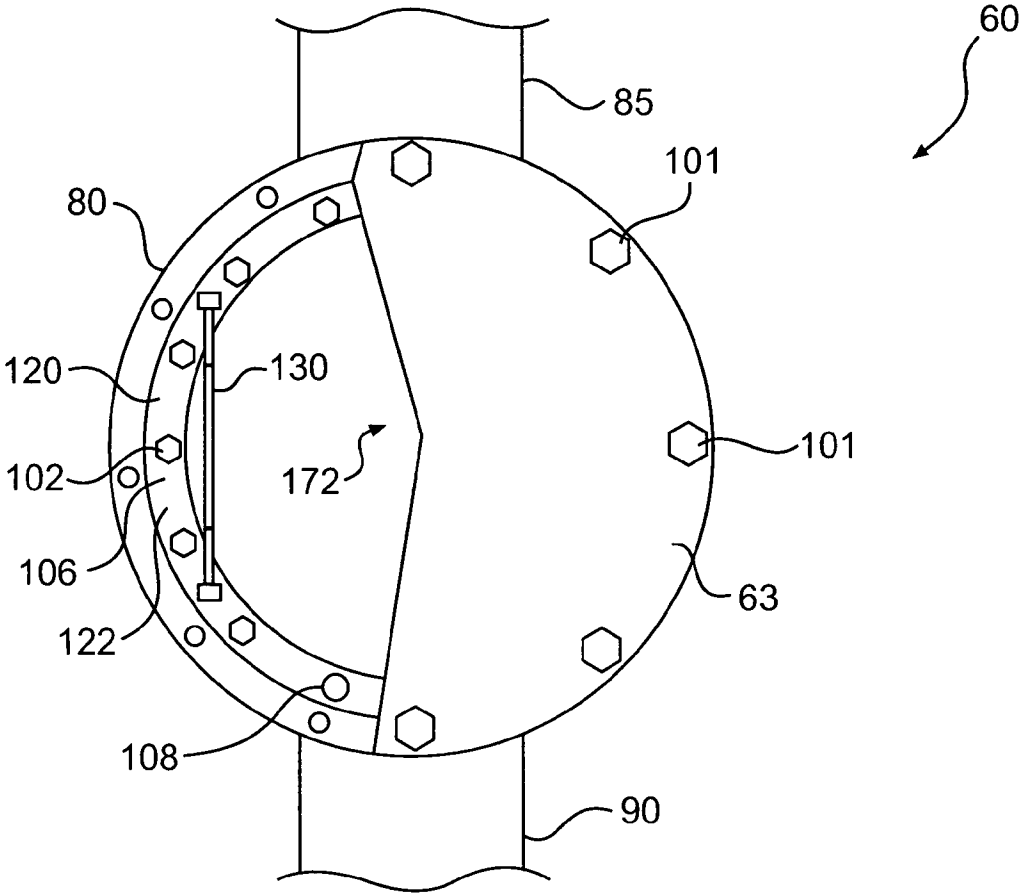
FIG. 3 is a schematic end view of an exemplary emissions control filer assembly consistent with disclosed embodiments.

The removable exhaust treatment unit 120 may also include at least one handle 130 coupled to the flange 106. The at least one handle 130 may be located adjacent the outlet end 172 of the removable exhaust treatment unit 120. FIG. 3 provides a schematic end view of the first end 60 of the enclosure 80 with part of the removable cover portion 63 cut away. As shown in FIG. 3, the at least one handle 130 may be attached to an end surface 122 of the flange 106. It will be understood that it is contemplated that the at least one handle 130 may include a plurality of handles 130. For example, one or more additional handles may be attached at various portions of the end surface 122 of the removable exhaust treatment unit 120. Also shown in FIG. 3 are the fasteners 102 on the end surface 122 of the flange 106. One of the apertures 108 for receiving a fastener 102 is also illustrated.

INDUSTRIAL APPLICABILITY

The disclosed emissions control filter assembly 40 may be applicable to any machine that produces exhaust gases, for example, from combustion of an air and fuel mixture. The emissions control filter assembly 40 may allow for easy removal of the removable exhaust treatment unit 120 for servicing without disassembling the emissions control filter assembly 40 from the exhaust system 53, thereby reducing time and saving cost on machine down time and labor.

Referring to FIG. 2, exhaust gases may enter inlet 90 and may be directed into the second chamber 112 of the enclosure 80. The flow director 180 may direct the exhaust gases from the second chamber 112 to the chamber 170 of the removable exhaust treatment unit 120 through the inlet end 174 of the removable exhaust treatment unit 120. The exhaust gases may be cleaned by the exhaust treatment element 150 when flowing through the chamber 170 of the removable exhaust treatment unit 120. After passing through the exhaust treatment element 150, the exhaust gases may be directed out of the removable exhaust treatment unit 120 through the outlet end 172 and into the first chamber 110 of the enclosure 80. Exhaust gases then may be directed out of the first chamber 110 of the enclosure 80 through the outlet 85.

After a period of time in service, the exhaust treatment element 150 may become saturated, for example, with particulate matter. The exhaust treatment element 150 then may need servicing, or the removable exhaust treatment unit 120 may need replacement. The removable exhaust treatment unit 120 may be removed without disassembling the emissions control filter assembly 40 from the exhaust system 53. For example, the removable exhaust treatment unit 120 may be removed without disconnecting the connection between the inlet 90 and the first exhaust conduit 41, and the connection between the outlet 85 and the second exhaust conduit 42. Bolts or screws 101 may be removed so that the removable cover portion 63 may be removed from the opening 65, allowing access to the removable exhaust treatment unit 120. Then, fasteners 102 may be removed, so that the coupling between the flange 106 and the annular support portion 160 may be released. An operator may then remove the removable exhaust treatment unit 120 from the enclosure 80 by pulling the removable exhaust treatment unit 120 out the enclosure 80, for example, using the at least one handle 130. The entire removable exhaust treatment unit 120 may be replaced with a new removable exhaust treatment unit 120. Alternatively, the exhaust treatment element 150 and the removable exhaust treatment unit 120 may be regenerated. As another alternative, the exhaust treatment element 150 may be removed from the housing 121 of the removable exhaust treatment unit 120 for cleaning or for replacement. After servicing, the removable exhaust treatment unit 120 may be re-installed in enclosure 80. Fasteners 102 maybe re-secured, and removable cover portion 63 may be replaced to cover opening 65.

With the removable cover portion 63 and the at least one handle 130, the removable exhaust treatment unit 120 can be accessed and removed while the emissions control filter assembly 40 remain connected within the exhaust system 53. Disassembling of the emissions control filter assembly 40 is unnecessary in order to access the removable exhaust treatment unit 120. Therefore, the disclosed filter assembly 40 may enable rapid servicing of the removable exhaust treatment unit 120 and/or the exhaust treatment element 150, and thus may save time and reduce cost.

It will be apparent to those skilled in the art that various modifications and variations can be made in the disclosed emissions control filter assembly and system. Other embodiments will be apparent to those skilled in the art from consideration of the specification and practice of the disclosed embodiments herein. It is intended that the specification and examples be considered as exemplary only, with a true scope of the disclosure being indicated by the following claims.

What is claimed is:

1. A removable exhaust treatment unit for an aftertreatment assembly, comprising:

a housing;

at least one exhaust treatment element coupled within the housing;

a flange on one end of the housing;

a plurality of apertures on the flange configured to receive a plurality of fasteners; and at least one handle coupled to the flange, the at least one handle extending inward from a perimeter of the flange and overlapping a portion of the at least one exhaust treatment element wherein the exhaust treatment unit is removable from an enclosure, and the flange is disposed within the enclosure and coupled to an inner support portion of the enclosure.

2. The removable exhaust treatment unit of claim 1, wherein the at least one handle includes a plurality of handles coupled to the flange.

3. The removable exhaust treatment unit of claim 1, wherein the housing is cylindrical.

4. The removable exhaust treatment unit of claim 1, wherein the at least one exhaust treatment element is selected from the group consisting of a diesel particulate filter, a NOx treatment component, a SOx treatment component, and a catalyst.

5. The removable exhaust treatment unit of claim 1, wherein the at least one exhaust treatment element is a filter substrate.

6. The removable exhaust treatment unit of claim 5, wherein the filter substrate is removable from the housing.

7. An engine system, comprising:

an internal combustion engine configured to combust air and fuel to produce exhaust gases;

a first exhaust conduit;

a second exhaust conduit; and an emissions control filter assembly, including:

an enclosure defining an interior and including an inlet, an outlet, and an opening, wherein the inlet is connected with the first exhaust conduit and configured to receive a flow of exhaust gases from the first exhaust conduit;

the outlet is connected with the second exhaust conduit and configured to direct the flow of exhaust gases to the second exhaust conduit; and the opening is configured to provide access to the interior;

a cover portion spaced from the outlet and removably coupled with the enclosure, and configured to cover the opening and prevent the flow of exhaust gases from flowing through the opening; and a removable exhaust treatment unit disposed within the interior of the enclosure and removably coupled with the enclosure, the removable exhaust treatment unit configured to contain at least one exhaust treatment element and to be removable through the opening when the cover portion is removed, wherein the outlet is included in a wall forming an outer perimeter of the enclosure, the outlet disposed between the cover portion and the exhaust treatment element.

8. The engine system of claim 7, wherein the outlet of the enclosure is located on a circumferential side surface portion of the enclosure adjacent the cover portion.

9. The engine system of claim 7, wherein the removable exhaust treatment unit further includes a flange removably coupled with an annular support portion protruding inwardly from an interior surface of the enclosure.

10. The engine system of claim 9, wherein the removable exhaust treatment unit further includes at least one handle coupled with the flange.

11. The engine system of claim 7, wherein the at least one exhaust treatment element is selected from the group consisting of a diesel particulate filter, a NOx treatment component, a SOx treatment component, and a catalyst.

12. The engine system of claim 7, wherein the emissions control filter assembly further includes an annular flow director extending from an inlet end of the removable exhaust treatment unit to an interior surface of the enclosure.

13. The engine system of claim 12, wherein the flow director is configured to seal a space formed between the enclosure and the removable exhaust treatment unit, and to direct the flow of exhaust gases from a chamber of the enclosure into the inlet end of the removable exhaust treatment unit.

14. An emissions control filter assembly, comprising:

an enclosure defining an interior and including an inlet, an outlet, and an opening configured to provide access to the interior;

a cover portion removably coupled with the enclosure and configured to cover the opening; and a removable exhaust treatment unit disposed within the interior of the enclosure and removably coupled with the enclosure, the removable exhaust treatment unit including:

a housing;

at least one exhaust treatment element coupled within the housing;

a flange on one end of the housing and disposed within the interior of the enclosure;

a plurality of apertures on the flange configured to receive a plurality of fasteners; and at least one handle coupled to the flange.

15. The emissions control filter assembly of claim 14, wherein the outlet of the enclosure is located on a circumferential side surface of the enclosure adjacent the cover portion.

16. The emissions control filter assembly of claim 14, wherein the at least one handle includes a plurality of handles coupled to the flange.

17. The emissions control filter assembly of claim 14, wherein the at least one exhaust treatment element is a filter substrate.

18. The emissions control filter assembly of claim 14, wherein the at least one exhaust treatment element is selected from the group consisting of a diesel particulate filter, a NOx treatment component, a SOx treatment component, and a catalyst.

19. The emissions control filter assembly of claim 14, further including an annular flow director extending from an inlet end of the removable exhaust treatment unit to an interior surface of the housing, the flow director configured to seal a space formed between the housing and the removable exhaust treatment unit, and to direct exhaust gas from a chamber of the housing into the inlet end of the removable exhaust treatment unit.

20. A method of providing an emissions control filter assembly, comprising:

providing a removable exhaust treatment unit;

securing an exhaust treatment element to the removable exhaust treatment unit;

providing an enclosure;

removably coupling a flange of the removable exhaust treatment unit with an annular support portion protruding inwardly from an interior surface of the enclosure, wherein removing the exhaust treatment unit from the enclosure comprises moving the flange across an exhaust outlet of the enclosure;

providing an opening in the enclosure to give access to the removable exhaust treatment unit; and providing a removable cover portion for the opening.

21. The removable exhaust treatment unit of claim 1, wherein the at least one handle extends across an outlet of the at least one exhaust treatment element from a first location on the perimeter to a second location on the perimeter different than the first location.

22. The removable exhaust treatment unit of claim 1, further including a layer of mating material disposed between the housing and the at least one exhaust treatment element.

23. The engine system of claim 7, wherein no particulate matter is removed from the flow of exhaust gases between the inlet of the enclosure and an inlet of the at least one exhaust treatment element.

24. The engine system of claim 7, wherein an inlet of the second exhaust conduit is coupled to the outlet of the enclosure.

25. The engine system of claim 7, wherein the outlet is disposed between a flange of the exhaust treatment unit and the cover portion.

26. The engine system of claim 7, wherein the outlet is disposed between a flange of the exhaust treatment unit and the opening of the enclosure.

27. The removable exhaust treatment unit of claim 1, wherein the exhaust treatment unit is removable from an enclosure, the at least one handle being disposed within the enclosure.

28. The engine system of claim 7, wherein the outlet comprises an opening in the wall forming the outer perimeter of the enclosure, the cover portion contacting the wall.

* * * * *